US009358171B1

(12) United States Patent
Crawford

(10) Patent No.: US 9,358,171 B1
(45) Date of Patent: Jun. 7, 2016

(54) PERSONALIZED DECORATIVE URN FOR PETS

(71) Applicant: Janice Crawford, Parma, OH (US)

(72) Inventor: Janice Crawford, Parma, OH (US)

( * ) Notice: Subject to any disclaimer, the term of this patent is extended or adjusted under 35 U.S.C. 154(b) by 0 days.

(21) Appl. No.: 14/822,798

(22) Filed: Aug. 10, 2015

(51) Int. Cl.
*A61G 17/08* (2006.01)
*A61G 99/00* (2006.01)
*A61G 17/00* (2006.01)

(52) U.S. Cl.
CPC ..... *A61G 17/08* (2013.01); *A61G 99/00* (2013.01); *A61G 2017/004* (2013.01)

(58) Field of Classification Search
CPC ..... A61G 17/00; A61G 17/08; A61G 99/00; A61G 2017/004; E04H 13/008; G09F 1/12; G09F 3/14
USPC ..... 27/1; 40/722, 725, 124.5, 673
See application file for complete search history.

(56) References Cited

U.S. PATENT DOCUMENTS 6,526,636 B2 * 3/2003 Bernhardt ..... A61G 17/08 27/1
6,735,831 B1 * 5/2004 Greiwe ..... A61G 17/08 27/1
7,562,423 B2 * 7/2009 Pryd-Kakuk ..... A61G 17/08 27/1
8,146,216 B2 * 4/2012 Creager ..... A61G 17/08 27/1
2006/0174461 A1 * 8/2006 Roberts ..... A61G 17/08 27/1
2009/0030804 A1 * 1/2009 Sell ..... A61G 17/00 705/26.5
2010/0058565 A1 * 3/2010 Roberts ..... A61G 17/08 27/1
2010/0269316 A1 * 10/2010 Roberts ..... A61G 17/08 27/1
2011/0099778 A1 * 5/2011 Johnson ..... E04H 13/008 27/1
2011/0209316 A1 * 9/2011 Roberts ..... A61G 17/08 27/1
2012/0180275 A1 * 7/2012 Kocir ..... A61G 17/08 27/1
2014/0047683 A1 * 2/2014 Cooke ..... A61G 17/08 27/1

* cited by examiner

*Primary Examiner* — William Miller
(74) *Attorney, Agent, or Firm* — The Keys Law Firm PLLC

(57) ABSTRACT

A personalized decorative urn for retaining the ashes of a loved one, such as a deceased pet, in a decorative container suitable to be personalized in a way to honor the loved one interred therein includes a container body which defines a rigid receptacle with integral side photo slots and a top neck sized to receive a removable lid. Each photo slot defines a three closed side, one open side enclosure which is sized to receive and securely hold a conventional printed photograph. The top neck is configured to allow an attachable card to be coupled with the container body through a decorative ribbon. In operation, the personalized decorative urn allows a loved ones ashes to be held in a container which has been decorated by an end user with photographs and other written indicia placed in the photo slots or in the attachable card.

2 Claims, 2 Drawing Sheets

PERSONALIZED DECORATIVE URN FOR PETS

BACKGROUND OF THE INVENTION

1. Field of the Invention

This invention relates generally to cremation containers and, more particularly, to a decorative urn for pets with integral card holder.

2. Description of the Prior Art

The use and design of conventional cremation containers, such as urns, is well known. A problem which still exists with such conventional urns, however, it is generally very difficult to personalize the structure, such as adding integral decorative elements which may be desired to better honor the deceased enclosed therein. Thus, there remains a need for a personalized decorative urn which would allow the addition of selected images which would be visible from the exterior thereof. It would be helpful if such a personalized decorative urn included a plurality of photo slots on its surface to allow the integration of various pictures by an end user. It would be additionally desirable for such a personalized decorative urn to have a card attachment for receiving written material or images for use in addition to or in the alternative of the photo slots.

The Applicant's invention described herein provides for a personalized decorative urn adapted to allow a user to selectively integrate one or more pictures of a deceased or other commemorative items with their urn. The primary aspects of Applicant's personalized decorative urn are a container body, photo slots, and a card attachment. When in operation, the personalized decorative urn provides a customized cremation container which allows as user to personalize the container holding a loved one. As a result, many of the limitations imposed by prior art structures are removed.

SUMMARY OF THE INVENTION

A personalized decorative urn for retaining the ashes of a loved one, such as a deceased pet, in a decorative container suitable to be personalized in a way to honor the loved one interred therein. The personalized decorative urn includes a container body which defines a rigid receptacle with integral side photo slots and a top neck sized to receive a removable lid. Each photo slot defines a three closed side, one open side enclosure which is sized to receive and securely hold a conventional printed photograph. The top neck is configured to allow an attachable card to be coupled with the container body through a decorative ribbon. In operation, the personalized decorative urn allows a loved ones ashes to be held in a container which has been decorated by an end user with photographs and other written indicia placed in the photo slots or in the attachable card.

It is an object of this invention to provide a personalized decorative urn which would allow the addition of selected images which would be visible from the exterior thereof.

It is another object of this invention to provide a personalized decorative urn which includes a plurality of photo slots on its surface to allow the integration of various pictures by an end user.

It is yet another object of this invention to provide a personalized decorative urn which has a card attachment for receiving written material or images for use in addition to or in the alternative of the photo slots.

These and other objects will be apparent to one of skill in the art.

DETAILED DESCRIPTION OF THE INVENTION

Figure 1:
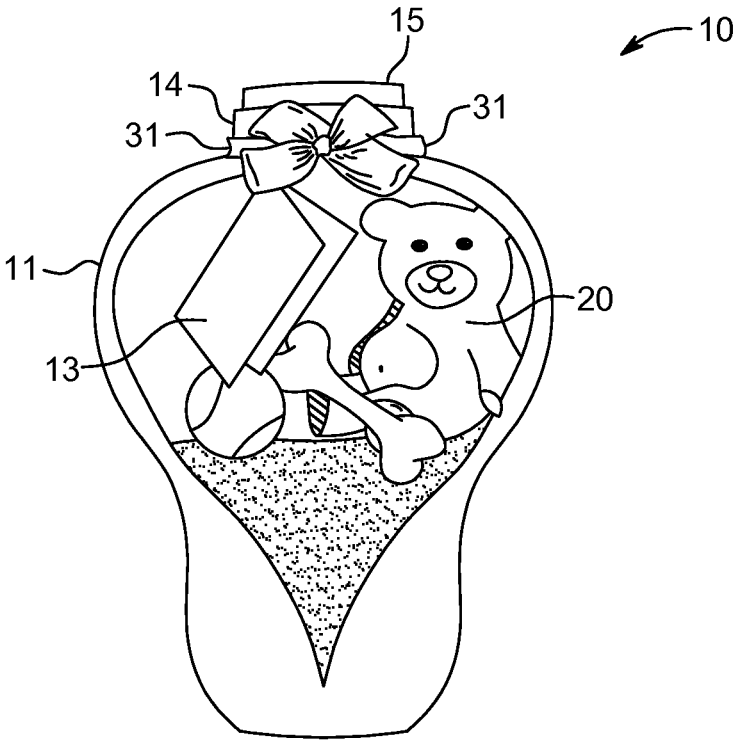
FIG. 1 is a front elevational view of a personalized decorative urn built in accordance with the present invention.
Figure 2:
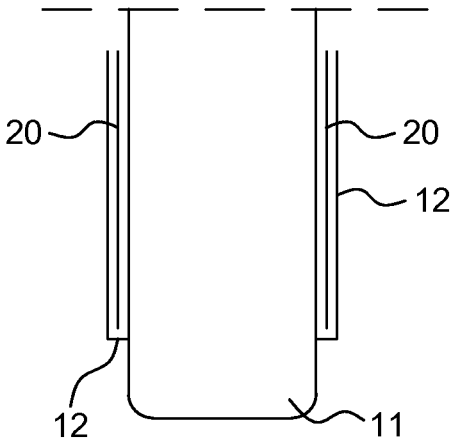
FIG. 2 is a partial side elevational view of a personalized decorative urn built in accordance with the present invention.
Figure 3:
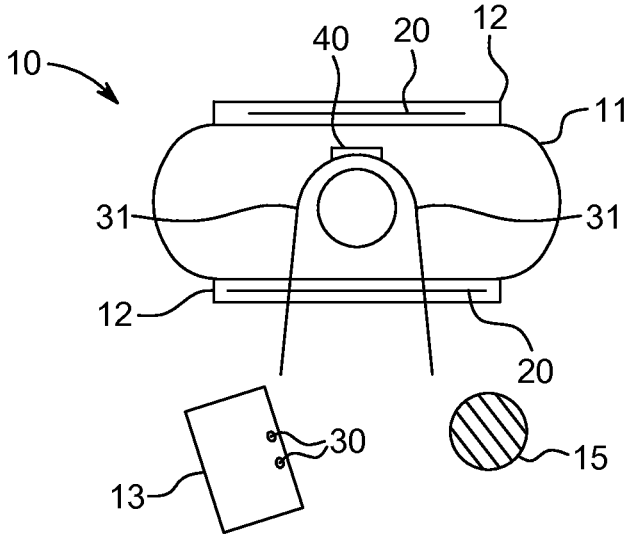
FIG. 3 is a top plan view of a personalized decorative urn built in accordance with the present invention.

Referring now to the drawings and in particular FIGS. 1, 2, and 3, a personalized decorative urn 10 is shown having a container body 11, photo slots 12, and an attachable card 13. The container body 11 defines a rigid receptacle with a top neck 14 with an opening sized to receive a removable lid 15. In the preferred embodiment, the container body 11 is constructed of a transparent material, such as glass or plastic.

Integral with the front side and the back side of the container body are discrete photo slots 12. Each photo slot 12 defines a three closed side, one open side enclosure which is sized to receive a conventional printed photograph 20. In the preferred embodiment, the open side of each photo slots 12 defines the top side so as to enable such a printed photograph 20 to be held in place in the photo slot 12 by a closed bottom and closed left and right sides.

It is contemplated that the closed sides of the photo slot 12 may be shaped to allow the photo slot 12 to hold photographs 20 of various shapes and sizes upright. In the embodiment illustrated in FIG. 1, the closed bottom of the photo slot defines an inverted triangle shape, thereby enabling it to hold the triangle bottom photograph 20 upright.

It is appreciated that in alternate embodiments, the photo slot 12 may include an open left side, open right side, or both, along with a closed top and bottom side. In such an embodiment, a photograph 20 may be inserted into or removed from the photo slot 12 through the open left and/or right side.

The attachable card 13 defines a planar or folded card member which may include an image or written indicia, or to which a photo or written indicia may be added. A ribbon aperture 30 through the card member is included to enable the attachable card 13 be coupled with a decorative ribbon 31 through passing one end of the ribbon 31 through the aperture 30. The ribbon 31 is adapted to be attached to the container body 11 so as to allow an attachable card 13 which has been coupled with the ribbon 31 to be connected to the container body 11.

In the preferred embodiment, the top neck 14 includes a ribbon slot 40 which is sized to receive the decorative ribbon 31. In such an embodiment, one side of the ribbon 31 can be passed through the ribbon slot 40 to integrate the ribbon 31 to the container body 11. The ends of the ribbon 31 can then either be tied together (with the attachable card 13 coupled therewith), as illustrated in FIG. 1, or allowed to hang loose, as illustrated in FIG. 3.

It is contemplated that the removable lid 15 may be fixed in the opening in the top neck 14 through friction engagement or through an adhesive.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A personalized decorative urn for the remains of pets, comprising:

a container body defining a rigid receptacle with a top neck, a front side, and a back side, wherein disposed in said top neck is an open top sized to receive a removable lid;

at least one photo slot which defines an enclosure having at least one open side and sized to receive a conventional printed photograph, wherein said at least one photo slot is integral with at least one of the front side and back side;

an attachable card defining a card member, wherein said attachable card is connected to the container body; and a ribbon slot integral with said top neck, wherein said card member includes a ribbon aperture therein and said attachable card is connected to the container body through a discrete ribbon which has been coupled with the attachable card through the ribbon aperture and attached to the top neck through the ribbon slot.

2. The personalized decorative urn for the remains of pets of claim 1, wherein said container body includes one photo slot integral with the front side and one photo slot integral with the back side.

* * * * *